US006511705B1

(12) United States Patent
Jetzer et al.

(10) Patent No.: US 6,511,705 B1
(45) Date of Patent: Jan. 28, 2003

(54) METHOD OF TREATING FABRIC

(75) Inventors: Jean Claude Jetzer, Nederweert Eind (NL); Carolus Bernardus Petrus van Olphen, Bavel (NL)

(73) Assignee: Hunter Douglas Industries B.V., Rotterdam (NL)

( * ) Notice: Subject to any disclaimer, the term of this patent is extended or adjusted under 35 U.S.C. 154(b) by 202 days.

(21) Appl. No.: 09/715,466

(22) Filed: Nov. 17, 2000

Related U.S. Application Data

(62) Division of application No. 08/932,224, filed on Sep. 17, 1997, now Pat. No. 6,159,875.

(30) Foreign Application Priority Data

Sep. 20, 1996 (EP) ..... 96202631

(51) Int. Cl.[7] ..... B05D 1/40

(52) U.S. Cl. ..... 427/209; 427/282; 427/288; 427/356; 427/358; 427/359; 427/394; 427/397.7; 427/397.8

(58) Field of Search ..... 427/209, 282, 427/288, 356, 358, 359, 394, 397.7, 397.8

(56) References Cited

U.S. PATENT DOCUMENTS

| | | | | |
|---|---|---|---|---|
| 2,202,488 A | | 5/1940 | Graham et al. | |
| 3,766,105 A | | 10/1973 | Chan | |
| 3,860,523 A | * | 1/1975 | Petrow et al. | 252/608 |
| 3,946,788 A | | 3/1976 | Van Muyen | |
| 4,508,776 A | | 4/1985 | Smith | |
| 4,562,107 A | * | 12/1985 | Daniels | 427/282 |

FOREIGN PATENT DOCUMENTS

| | | |
|---|---|---|
| DE | 2152213 | 5/1973 |
| EP | 007745 | 2/1980 |
| EP | 573772 | 12/1993 |
| EP | 757085 | 2/1997 |
| WO | 9405727 | 3/1994 |
| WO | 9626070 | 8/1996 |

* cited by examiner

*Primary Examiner*—Katherine A. Bareford
(74) *Attorney, Agent, or Firm*—Dorsey & Whitney LLP

(57) ABSTRACT

The invention relates to a method of treating fabric material which may be used for a window covering, for example. The fabric has a first finish on a first side provided by a first pigment having a first particle size and a second finish on the second side provided by a second pigment having a second particle size larger than the first particle size. The material may be produced by a method in which the first and second finishes are applied simultaneously by a single operation.

37 Claims, 2 Drawing Sheets

METHOD OF TREATING FABRIC

CROSS-REFERENCE TO RELATED APPLICATION

This application is a division of U.S. patent application Ser. No. 08/932,224, filed Sep. 17, 1997, now U.S. Pat. No. 6,159,875, issued Dec. 12, 2000, which application corresponds and claims priority to European Application No. 96202631.6, filed Sep. 20, 1996. Each of the above-identified applications is hereby incorporated by reference as though fully disclosed herein.

BACKGROUND OF THE INVENTION

The present invention relates to a fabric material having a first finish on a first side of said fabric material and a second different finish on an opposite second side of said fabric material. The invention also relates to a method of treating a fabric and a window covering comprising such a fabric.

One method of treating a fabric material for a window covering product is inter alia known for curtains and shades, in particular of pleated blinds, such as described in the U.S. Pat. No. 3,946,786. Pleated blinds like the ones described in the mentioned patent, usually incorporate fabric material that is coloured on the first side to enhance the decorative function of such window covering product, while being metallized on the opposite second side for reflecting sunlight or heat.

One method for producing such fabric material involves metallizing by vacuum deposition, while colourinq is done in a separate printing operation after said metallizing.

A disadvantage of such a method is that although being reasonably effective, such a method is rather expensive, whereas the quality of the window covering product, particularly the durability of the metallization, especially in hostile environments has been somewhat disappointing. Chemical and mechanical damage of metallized fabrics is often experienced in greenhouse or skylight installations where extreme heat and humidity conditions usually prevail. Also, domestic window cleaning agents if spilt on the metallized side of known fabric window covering products have been found to have aggressive components which can damage the metallized layer. Finally, also insect excrements often found in these overhead installations can do damage to the reflective layer.

BRIEF SUMMARY OF THE INVENTION

According to the present invention there is provided a fabric comprising a fabric material having opposite sides; a first finish on one side and a second finish on the other side; said first finish comprising a mixture including a first pigment having a first particle size and said second finish comprising a mixture including a second pigment having a second particle size, said second particle size being larger than said first particle size.

Such a fabric can overcome many of the above disadvantages. In a preferred fabric, according to the invention, the first pigment is darker than said second pigment.

Advantageously the second pigment is light reflective and may, for example, be mica.

Desirably said first pigment has a particle size of 1 to 10 microns, preferably 1 to 3 microns, and said second pigment has a particle size of 10 to 180 microns, preferably 10 to 60 microns.

The chemical and mechanical properties of the fabric materials according to the invention are superior to those of traditional metallized fabrics and result in appropriate reflective values. As an example, the fabric of the invention can be resistant to moisture, condensation, window cleaning products, insect excrements and extreme temperature conditions. So, the product of the invention if used as a reflective window covering product, has substantially equal heat and light reflective properties to conventional metallized fabric, but at the same time has an improved resistance against damage and wear during use.

The invention also provides a method of treating a fabric material to obtain a first finish on a first side of said fabric material and a second different finish on an opposite second side of said fabric material, characterized in that said first and second finishes are applied simultaneously by a single operation.

Such a method of treating can achieve more economical—manufacturing of fabric material for window covering products and provide more economical, and at the same time more aesthetically pleasing window covering products.

The use of a single operation according to the invention provides an improvement as the fabric is subjected to shorter treatment which is also more economical. Such single operation may comprise the steps of providing said fabric, material having a hydrophilic character, applying a fluid dispersing medium to the second side of said fabric material, said fluid dispersing medium comprising first pigment—particles for providing said first finish, said first pigment particles having a first size, second pigment particles for providing said second finish, said second pigment particles having a second size larger than said first size, allowing said first pigment particles to permeate substantially through said fabric material to the first side while at least said second pigment particles remain substantially on the second side, and subsequently drying said fabric material.

With such single operation the fabric material is favourably used to separate the second pigment particles which are destined for the second side only, from the first pigment particles. The hydrophilic character of the fabric material, the properties of the fluid dispersing medium and the size difference between the discrete pigment particles together account for the effect that is achieved by the invention.

If different coloured pigment particles are used it should be understood that darker pigment particles if available in a sufficient concentration will usually dominate any light coloured pigment particles. With the fabric material for window covering products referred to herein above, light reflective or metal second pigment particles would be desired on the second side of the fabric material. If such reflective second pigment particles in the method of the invention are combined with somewhat darker coloured first pigment particles on the same side of the fabric material, the additional benefit is obtained that also the light reflective second side obtains the colour of the first side of the fabric material, which is advantageous from a decorative point of view. Such improvement can be obtained, while achieving at the same time appropriate reflective properties. Many types of fabric materials and pigment particles are suitable in practising the invention. Similarly, several conventional coating techniques such as printing by a rotary screen printing process may be adapted successfully to practise the present invention.

According to one embodiment of the invention, said reflective properties may be obtained by using pearlescent or iridescent second pigment particles such as mica. Fabric materials having a pearlescent side may be used in window coverings referred to herein above as a replacement for metallized fabrics in known pleated blinds and roller shades. By using mica particles with the method of the present invention the majority of the above problems can be overcome. A further advantage of a fabric material for a window covering product according to such an embodiment is a reflective side that can be colour matched to the nonreflective side, but still offer the same reflective properties. This decorative advantage is not available to metallized fabrics which always have a distinct gray or metal-like appearance on their reflective sides, obviously other inorganic particles or alternatively reflective metal particles may be used if different effects are sought.

The invention also comprises embodiments in which additional decorative or functional patterns are printed on the fabric material. This may be effected either prior to or subsequent to the single operation of the present invention.

A window covering product in accordance with the present invention may readily be made such that the second side is substantially of the colour as the first side. By use of the method the possibility arises to achieve the light reflective properties with a coloured finish. Such a window covering product can thus have different aesthetic and physical properties on opposite sides while being substantially of a matching colour.

A particular advantage as opposed to conventional metallized fabric is the ability of applying a subsequent crushing treatment for decorative purposes.

BRIEF DESCRIPTION OF THE DRAWINGS

Above-mentioned and other more detailed aspects of the invention are further described and illustrated, by way of non-limiting example, with reference to the accompanying drawings in which.

DETAILED DESCRIPTION OF THE DRAWINGS

Figure 1:
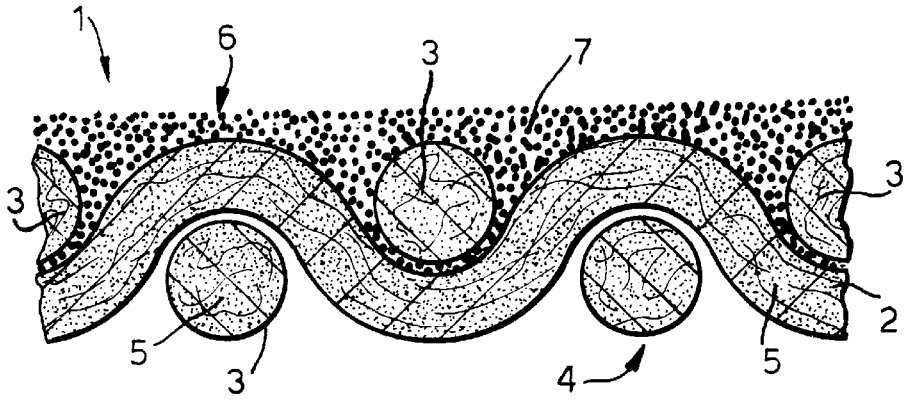
FIG. 1 shows an enlarged cross section through a fabric material treated in accordance with the method of the invention.

As shown in FIG. 1, the fabric material, here a woven fabric 1, comprises warp yarns 2 and weft yarns 3. The yarns or threads of the fabric are preferably of synthetic fibre and comprise filament fibres. Natural fibres such as cotton or blends thereof with synthetic fibres are also suitable. A particularly suitable synthetic fibre is polyester. Polyamide and silk have been found less suitable for certain use of the present invention such as window shades. The fabric 1 for a window covering product is preferably closely woven, such that it has interstices which are relatively small compared to the diameter of the weft and warp yarns or threads. Alternatively a fabric with initially somewhat larger interstices may be calendered in advance to flatten the fabric yarns and thereby close the interstices to a smaller dimension. Visible from the bottom side 4 of the fabric I are first pigment particles 5 which have impregnated the yarns. These are colour pigment particles with a size of 1 to 10 microns. Same pigment particles are present in the yarns through out the fabric. At the top side 6 of the fabric there are larger second pigment particles 7 which are substantially larger than particles 5 and unable to permeate into the yarns. The large pigment particles 7 in this embodiment have a size within the range of 10 to 180 microns. For screen printing a size range is chosen preferably within the range of 10 to 60 microns.

In a preferred embodiment of a fabric material treated in accordance with the invention, silicate second particles 7 having reflective properties similar to those found in metallized fabric are used. Silicate particles that have a layered structure are usually referred to as mica, which form is particularly suitable for pigment particles; mica particles may be coloured and are preferably coated with titanium-dioxide. The extent to which the colour particles 5 permeate into the yarns of the fabric is dependent on the chosen parameters in the process described herein below.

The effect of having an appropriate amount of colour particles 5 combined with mica particles 7 on the same side of the fabric is a coloured reflective side that approaches the colour of the non-reflective side of the fabric. The fabric material 1, if so desired, can be pre-dyed or comprise any amount of pre-dyed yarns or threads. Special effects may be obtained by using pre-dyed warp yarns or weft yarns in a particular arrangement. Also the fabric can be pre-printed on one or both of its sides and such preprinting may establish a pattern or be homogenous.

Finally the fabric material 1 which in here represented as a woven one, can be replaced by a knitted fabric or even by a non-woven fabric, provided that it has the required hydrophilic character in its yarns for the colour pigment particles to impregnate. Also the fabric material can comprise essentially filament type fibres.

If calendering is used to make a particular fabric more suitable for the present invention, then such calendaring is preferably carried out at a temperature of between 170° C. and 220° C. and a pressure of up to 300 daN per cm. Calendering flattens the fabric material, which improves the reflective properties when reflective particles are applied. The process of the present embodiment will now be described with reference to FIG. 2.

Figure 2:
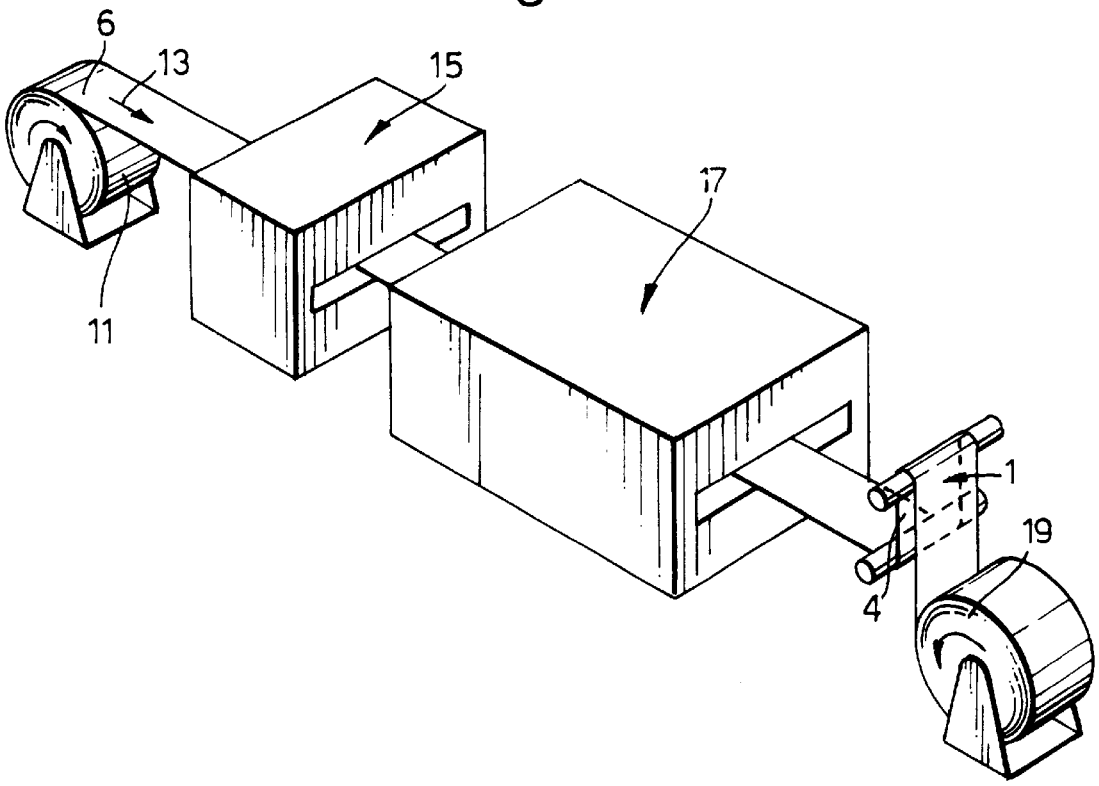
FIG. 2 is a schematic representation showing an installation for practising the method of the invention.

FIG. 2 is a schematic representation showing an installation for practising the method of the invention. A supply roll 11 with the fabric material 1 is being unwound in the direction of arrow 13, such that one side 6 of the fabric material is directed upwardly and the opposite side 4 is directed downwardly.

Reference 15 generally indicates a means for applying a printing substance containing the pigment particles 5 and 7. This could be a printing screen, such as a rotary printing screen of a type commonly used in textile printing. Conceivably, however, the printing substance might also be applied using a knife or doctor blade or by spraying. In the described embodiment the reference 15 is presumed to indicate a coating unit of a conventional type suitable for textile printing or coating. The printing substance applied by the coating unit is a dispersing medium such as a printing paste which forms a suitable vehicle of the pigment particles 5 and 7 with a binding agent or combination of binders and additives as may be required. The printing paste bass is conventional to textile printing and usually is of an aqueous type. Such an aqueous printing paste bass contains water mixed with a appropriate thickener. The viscosity of such a printing paste can be adjusted in relation to the fabric material to be coated and in respect of other process parameters.

Pigment particles are uniformly distributed in the basic printing paste and one or more suitable binders are added for bonding of the pigment particles to the textile material. Preferably a heat curable resin binder is chosen that is suitable for bonding both the pigment and the mica particles. Such a binder material may be heat activable acrylates, butadienes, rubber latexes, PVC-plastisols or copolymers including one or more of the above such as polyurethane-butadien, styrene-acrylate or polyvinyl-acetate. Any number of additional additives such as wetting agents, surfactants, penetrating agents, emulsifiers, solidifiers, anti-foaming agents, handle modifiers, thickening agents, fixers or fire retarding substances may be added to the printing paste. In particular wetting agents, anti-foam agents, rheoloqical improvers, de-aerating compounds and surfactants are recommended with the method of the invention.

After application of the printing paste in the coating unit 15 the fabric progresses through a drying oven 17 which may be combined with, or followed by, some form of tenter frame or stentor of conventional design. In the oven 17 the water from the printing paste is evaporated while the binder is heat activated, by which action the particles will be adhered to the fibres in the fabric material. Appropriate drying and heating is obtained at a temperature of about 190° C. for a duration of about 30 seconds. The progressive speed of the fabric will be governed by the time necessary for allowing the printing paste to transport and distribute the pigment particles over and the smaller pigment particles by permeation into the yarns of the fabric. Given the speed of the fabric, the oven temperature can be established in relation to the length of the drying oven or the number of bays in a stentor to achieve the required temperature and duration for the treated fabric to be dried. Upon leaving the oven the fabric I can be gathered on a roll 19 or alternatively may proceed to further treating stages, such an further coating, calendering chintzing, pleating, solidifying, printing, crushing or impregnating.

Figure 3:
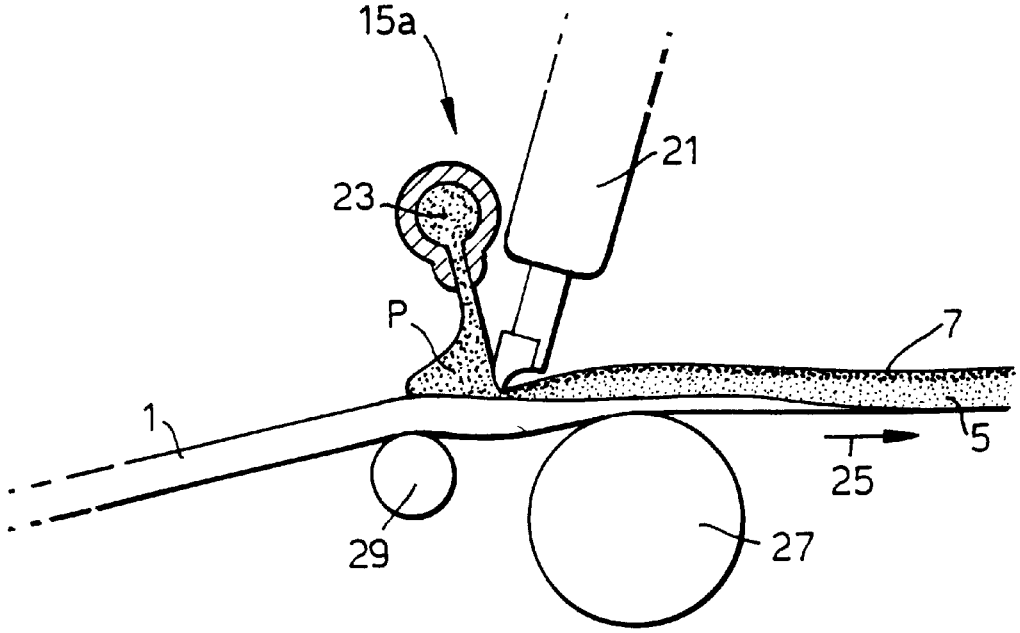
FIG. 3 is a schematic representation of a knife coating unit for use with the method of the invention.

FIG. 3 is a schematic representation of a knife coating unit for use with the method of the invention, which is one possible form of the coating unit. The coating unit 15*a* uses a knife or doctor blade 21. The printing paste P is supplied upstream of the knife 21 by a supply system 23. The knife 21 is positioned to engage the fabric 1 which is moving in the direction of arrow 25 between a counter pressure roller 27 and a secondary support roller 29. As indicated schematically in FIG. 3 the colour pigment particles 5 are distributed through the yarns of the fabric 1, while the larger light reflective particles 7 remain on the upper side of the fabric only.

Figure 4:
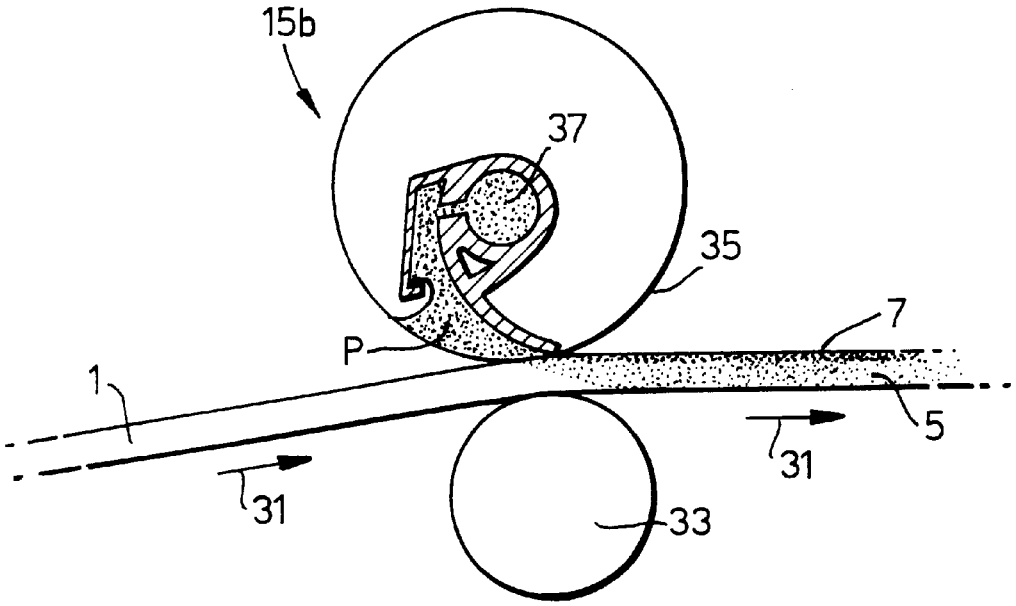
FIG. 4 is a schematic representation of a rotary screen printing unit for use with the method of the invention.

FIG. 4 is a schematic representation of a rotary screen printing unit for use with the method of the invention, which is another advantageous form of the coating unit. The coating unit 15*b* is shown as a rotary screen printing unit. As schematically shown in FIG. 4 the fabric I is moving in the direction of arrows 31 and is supported by a counter pressure roller 33. Immediately above the counter pressure roller 33 is positioned a rotary screen 35 in which interior is positioned a stationary squeegee 37. The squeegee 37 is provided with means to distribute the printing paste P which contains the large pigment particles 7 in combination with the small size pigment particles 5. A printing screen for use with rotary screen printing with an embodiment of the method of the invention has a mesh size from about So to 135 apertures per inch.

The fabric material treated by the afore-described S method is particularly suitable for window covering products, which often require different characteristics on different sides.

The combined use of pearlescent mica second pigment particles that adhere only to the surface of the yarns, and colour first pigment particles that permeate the fibrous structure of the yarns, makes it possible to obtain a reflective second side that has substantially the same colour as the decorative first side. The reflective side would normally be exposed to sunlight and the decorative side would be directed towards the room interior.

For window covering applications it may also be advantageous to use fire retardant fabric material or to treat such material to become fire retardant.

A particular advantage of the present invention is that the fire retardant treatment compositions may be incorporated in the printing paste for the same single treatment operation.

Other window fabric treatment or general textile treatment operations may also be combined with the present invention. Such would include the incorporation of hardening or water-repellency improving agents into the printing paste for the single treatment operation. Suitable hardeners for incorporation into the printing paste include polymers based on n-butylacrylate and acrylonitrile. The resistance against mechanical and chemical deterioration of the reflective layer can be further exploited by additional mechanical fabric treatments such as crushing. Crushing which is applied to fabrics to obtain a particular decorative affect has not before been possible with the known kinds of reflective fabric.

The advantage of resisting mechanical and chemical deterioration further allows the fabric material to be washable.

The invention is further illustrated below in two examples, which are not restrictive in any respect.

EXAMPLE 1

A woven fabric material of 60 q/m$^2$ having the following constitution.

warp 40 threads/cm, 100 decitex polyester filament yarn,
waft 21 threads/cm, 200 decitex spun polyester (PES) yarn.

is subjected to a one aided calendering by passing it between a hard roller and a soft roller. The fabric material is subsequently printed using a rotary screen printing mesh of 135 holes per inch and a printing paste as follows:

| | |
|---|---|
| aqueous printing paste in the form of an acrylate based thickener: | 85.5% by weight, |
| anti-foam agent comprising saturated aliphatic and aromatic hydro-carbons: | 0.1% by weight, |
| wetting agent comprising ionic tensides such as isatridecanolothoxylate: | 0.1% by weight, |
| rheological improver comprising polyglycolethers of fat alcohols in an aqueous solution: | 0.5% by weight, |
| hydrophilic improver in the form of ureum: | 0.5% by weight, |
| silicon de-aeration compound: | 0.2% by weight, |
| red pigment particles (1 to 3 microns) | 1.0% by weight, |
| mica pearlescent particles (10 to 60 microns) | 12.0% by weight. |

The viscosity of this printing paste is adjusted in the usual manner to be about 42 poise. The fabric so treated is dried by passing through a drying oven at a speed of about 20 meters per minute and at a temperature of 150 ° C.

The fabric is subsequently finished, hardened and stabilized an usual. The finished fabric shows appropriate reflection values and excellent resistance against humidity, cleaning detergents and extreme temperature conditions.

EXAMPLE 2

A woven fabric material of 80 q/M$^2$ having the following constitution:

warp: 41 threads/cm, 80 decitex Polyster (PES) yarn, weft: 24 treads/cm, 200 decitex Polyster (PES) yarn is subjected to a one sided calendering as in example 1. This fabric material is then coated with a knife coater using a printing paste as follows:

| | |
|---|---|
| aqueous printing paste in the form of an acrylate based thickener: | 85.5% by weight, |
| anti-foam agent comprising saturated aliphatic and aromatic hydro-carbons: | 0.1% by weight, |
| wetting agent comprising ionic tensides such as isotridecanolethoxylate: | 0.1% by weight, |
| rheological improver comprising polyglycolethers of fat alcohols in an aqueous solution: | 0.6% by weight, |
| hydrophilic improver in the form of ureum: | 0.5% by weight, |
| silicon de-aeration compound: | 0.2% by weight, |
| red pigment particles (1 to 3 microns) | 1.0% by weight, |
| mica pearlescent particles (20 to 180 microns): | 12.0% by weight. |

The viscosity of this printing paste is adjusted in the usual manner to be about 49 poise. The coated fabric is then dried in a 9-bay stentor at a speed of about 20 meters per minute and up to a temperature of 190° C. This fabric is subsequently calendered to obtain a chintz finish by subjecting it to the action of a polishing roll. A finished chintz fabric is thus obtained with good resistance against mechanical deterioration and still better reflective values than the fabric from example 1. The latter effect is to be attributed to redirecting and alignment of the mica particles by the additional chintzing calendering.

The above disclosure is given by way of example. A many of average skill in the art is also believed to be able to incorporate other techniques, different or similar, when further practising the above disclosure.

What is claimed is:

1. A method of treating a fabric to provide a fabric material having a first finish on a first side of said fabric material and a second different finish on an opposite second side of said fabric material, characterized in that said first and second finishes are applied simultaneously by a single operation, the method comprising the steps of:

providing said fabric having a hydrophilic character;

applying a fluid dispersing medium to said second side of said fabric, said fluid dispersing medium comprising first pigment particles for providing said first finish, said first pigment particles having a first size, and second, light-reflective pigment particles for providing said second finish, said second pigment particles having a second size, larger than said first size;

allowing said first pigment particles to permeate through said fabric to said first side, thereafter being present on said second and first sides of said fabric and in a middle of said fabric, while said second, light-reflective pigment particles are restricted to said second side; and subsequently drying said fabric material.

2. The method according to claim 1, characterized in that said second pigment particles comprise pearlescent particles.

3. The method according to claim 1, characterized in that said second pigment particles comprise a silicate material.

4. The method according to claim 3, characterized in that said second pigment particles comprise mica particles.

5. The method according to claim 4, characterized in that said mica particles are coated with titanium-dioxide.

6. The method according to any one of claims 1 to 5, characterized in that said second pigment has a particle size of 10 to 180 microns.

7. The method according to claim 6, characterized in that said second pigment has a particle size of 10 to 60 microns.

8. The method according to claim 7, characterized in that said first pigment comprises particles having a particle size of 1 to 10 microns.

9. The method according to claim 8, characterized in that said first pigment comprises particles having a particle size of 1 to 3 microns.

10. The method according to claim 9, characterized in that said fabric has a fiber structure.

11. The method according to claim 10, characterized in that said fabric is selected from the group consisting of fabrics having a pre-printed pattern, fabrics that are pre-dyed, and fabrics that include pre-dyed yarns.

12. The method according to claim 11, characterized in that said fabric is selected from the group consisting of fabrics having synthetic fibers and fabric that are calendered.

13. The method according to claim 12, characterized in that said fabric material is heated subsequent to receiving said fluid dispersing medium.

14. The method according to claim 13, characterized in that said fluid dispersing medium includes a hardening agent.

15. The method according to claim 14, characterized in that said fluid dispersing medium is a printing paste having a viscosity that has been adjusted in relation to the fabric material to be coated.

16. The method according to claim 15, wherein said printing paste includes water mixed with a thickener paste.

17. The method according to claim 15, characterized in that said printing paste comprises at least one binder which is selected from the group consisting of acrylates, butadienes, rubber latexes, PVC plastisols, and co-polymers including polyurethane-butadiene, styrene-acrylate and polyvinyl-acetate.

18. The method according to claim 17, characterized in that said printing paste contains additives selected from the group consisting of wetting agents, surfactants, penetrating agents, emulsifiers, solidifiers, anti-foaming agents, hardeners, handle-modifiers, and fire retarding substances.

19. The method according to claim 18, characterized in that said fluid dispersing medium is applied by a screen printing process.

20. The method according to claim 19, characterized in that said screen printing process is a rotary screen printing process.

21. The method according to claim 20, characterized in that said screen printing process applies said fluid dispersing medium with said second pigment particles having a size ranging from 10 to 60 microns, said screen printing process using a printing screen having a mesh size of 105 to 135 apertures per inch.

22. The method according to claim 21, characterized in that said fluid dispersing medium is applied by a knife.

23. The method according to claim 1, characterized in that said first pigment comprises particles having a particle size of 1 to 10 microns.

24. The method according to claim 23, characterized in that said first pigment comprises particles having a particle size of 1 to 3 microns.

25. The method according to claim 1, characterized in that said fabric has a fiber structure.

26. The method according to claim 1, characterized in that said fabric is selected from the group consisting of fabrics having a pre-printed pattern, fabrics that are pre-dyed, and fabrics that include pre-dyed yarns.

27. The method according to claim 1, characterized in that said fabric is selected from the group consisting of fabrics having synthetic fibers and fabric that are calendered.

28. The method according to claim 1, characterized in that said fabric material is heated subsequent to receiving said fluid dispersing medium.

29. The method according to claim 1, characterized in that said fluid dispersing medium includes a hardening agent.

30. The method according to claim 1, characterized in that said fluid dispersing medium is a printing paste having a viscosity that has been adjusted in relation to the fabric material to be coated.

31. The method according to claim 30, wherein said printing paste includes water mixed with a thickener paste.

32. The method according to claim 31, characterized in that said printing paste comprises at least one binder which is selected from the group consisting of acrylates, butadienes, rubber latexes, PVC plastisols, and co-polymers including polyurethane-butadiene, styrene-acrylate and polyvinyl-acetate.

33. The method according to claim 30, characterized in that said printing paste contains additives selected from the group consisting of wetting agents, surfactants, penetrating agents, emulsifiers, solidifiers, anti-foaming agents, hardeners, handle-modifiers, and fire retarding substances.

34. The method according to claim 1, characterized in that said fluid dispersing medium is applied by a screen printing process.

35. The method according to claim 34, characterized in that said screen printing process is a rotary screen printing process.

36. The method according to claim 34, characterized in that said screen printing process applies said fluid dispersing medium with said second pigment particles having a size ranging from 10 to 60 microns, said screen printing process using a printing screen having a mesh size of 105 to 135 apertures per inch.

37. The method according to claim 1, characterized in that said fluid dispersing medium is applied by a knife.

* * * * *